US006062175A

United States Patent [19]

Huang

[11] Patent Number: 6,062,175

[45] Date of Patent: May 16, 2000

[54] ROTATING CYLINDER INTERNAL-COMBUSTION ENGINE

[76] Inventor: Shih-Pin Huang, No. 12, Lane 226, An Kang Rd., Taipei, Taiwan

[21] Appl. No.: 09/293,787

[22] Filed: Apr. 20, 1999

[51] Int. Cl.[7] ..... F02B 57/00

[52] U.S. Cl. ..... 123/43 R; 123/44 D

[58] Field of Search ..... 123/44 R, 44 D, 123/43 R

[56] References Cited

U.S. PATENT DOCUMENTS

| | | | |
|---|---|---|---|
| 1,249,845 | 12/1917 | Soppitt | 123/44 D |
| 2,990,820 | 7/1961 | Saijo | 123/44 D |
| 4,166,438 | 9/1979 | Gottschalk | 123/44 D |
| 4,741,300 | 5/1988 | Benson | 123/44 D |
| 5,123,394 | 6/1992 | Ogren | 123/44 D |

FOREIGN PATENT DOCUMENTS

| | | | |
|---|---|---|---|
| 329203 | 11/1920 | Germany | 123/44 D |
| 601657 | 12/1977 | Switzerland | 123/44 D |
| 19203 | 8/1914 | United Kingdom | 123/44 D |
| 130732 | 7/1919 | United Kingdom | 123/44 D |

*Primary Examiner*—Michael Koczo
*Attorney, Agent, or Firm*—Bacon & Thomas

[57] ABSTRACT

An internal combustion engine comprises multiple cylinder blocks in series rotatablely mounted in a single casing. The cylinder blocks each define multiple cylinders along a circumferential portion of the cylinder block to receive a piston in each one. The casing forms multiple spark plug holes and defines multiple exhaust ports and multiple intake ports in the periphery thereof. Each the cylinders is accessible to the spark plugs, the exhaust ports and the intake ports upon rotation of the cylinder block. The spark plugs, the exhaust ports and the intake ports of various cylinder blocks are staggered.

4 Claims, 6 Drawing Sheets

ROTATING CYLINDER INTERNAL-COMBUSTION ENGINE

BACKGROUND OF THE INVENTION

1. Field of the Invention

The present invention relates to an internal-combustion engine, and more particularly to an efficient internal-combustion engine comprising multiple cylinder block in series mounted in a single casing, wherein each of the cylinder block comprises multiple cylinders that drive the cylinder block to rotate integrally therewith.

2. Description of Related Art

An internal combustion engine is a commonly used machine that converts the energy store in some fuel into motion. All internal combustion engines use a "fixed-cylinder" configuration. A piston in a cylinder and a connecting rod between the piston and the main engine shaft convert the expanding gases in burning fuel from reciprocating linear motion initiated in the piston to rotary movement of the main engine shaft thereby supplying energy in the form of a rotating shaft at the output of the engine. However, this type of the internal combustion engine is inefficient. High-power output requires a large cylinder with many ancillary devices, such as a radiator, fuel pump, carburetor and so on. Thus, fabrication cost and maintenance cost will be high.

An internal combustion engine with rotary cylinders in accordance with the present invention tends to mitigate and/or obviate the aforementioned problems.

SUMMARY OF THE INVENTION

The main object of the present invention is to provide an internal combustion engine comprised of multiple cylinder blocks in series mounted a single casing, with the advantage of space and/or weight reduction and efficient power and/or performance improvement.

Other objects, advantages and novel features of the invention will become more apparent from the following detailed description when taken in conjunction with the accompanying drawings.

DETAILED DESCRIPTION OF THE PREFERRED EMBODIMENT

Figure 1:
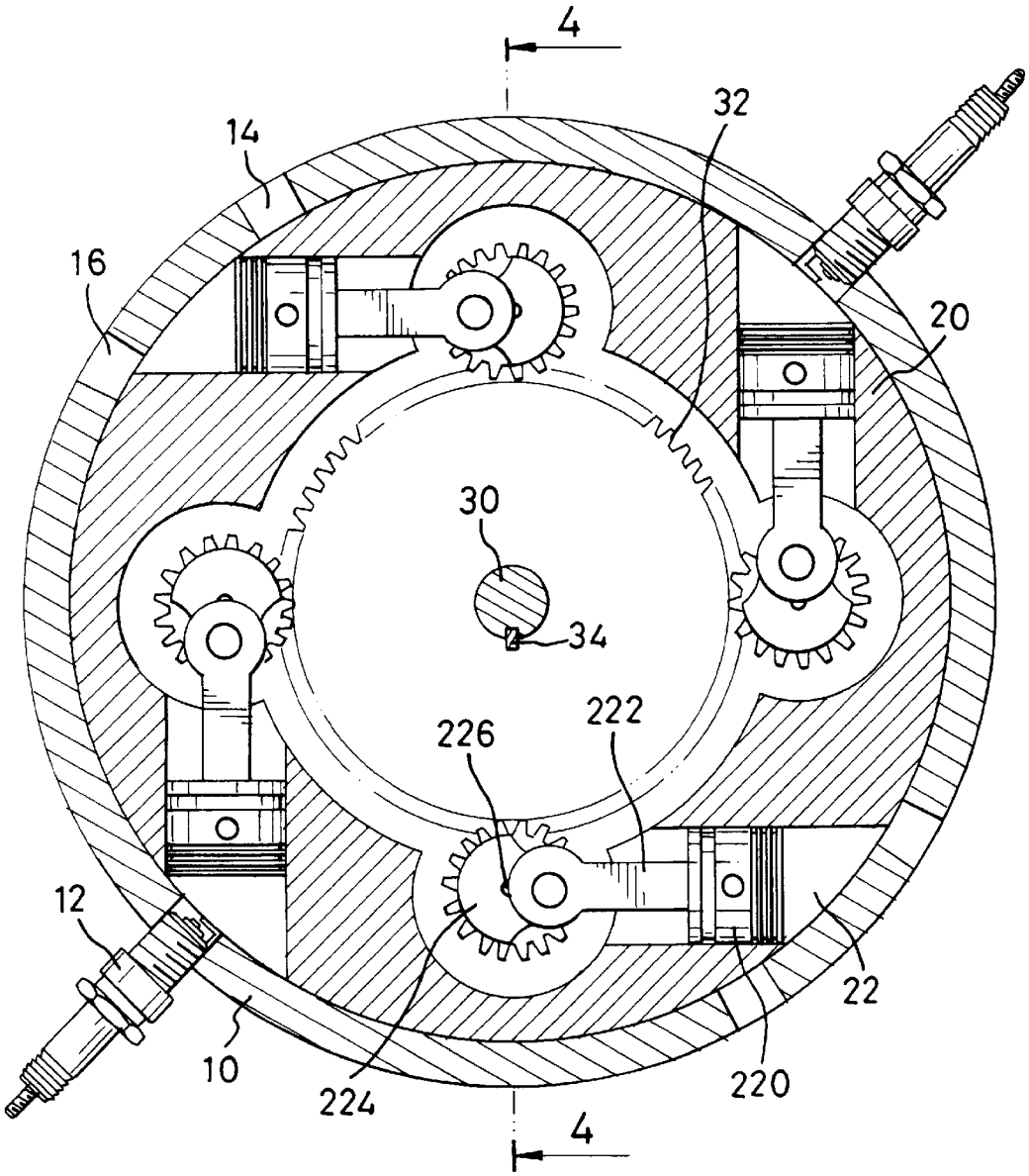
FIG. 1 is a cross-sectional view of a cylinder block of the present invention.
Figure 4:
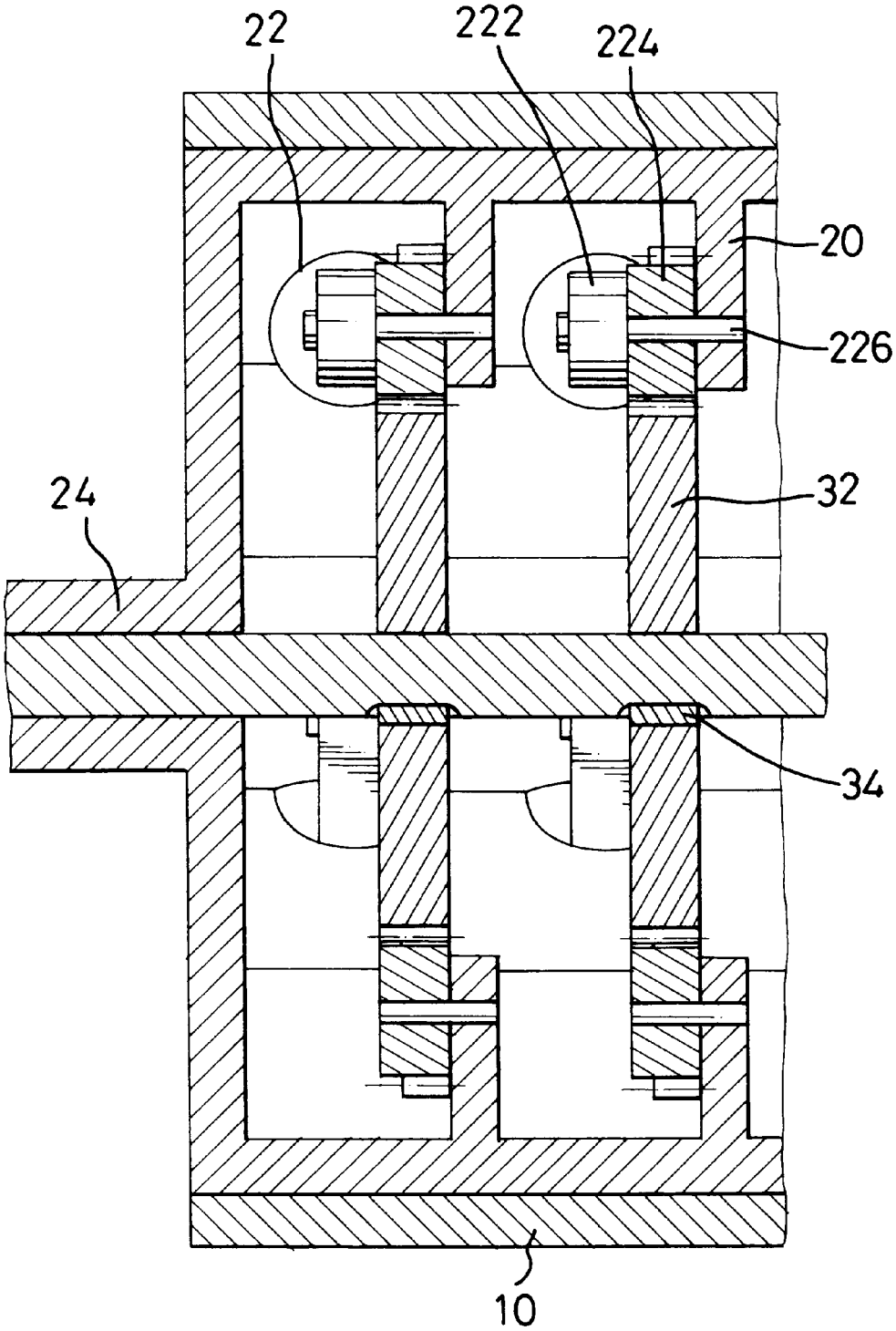
FIG. 4 is a longitudinal-sectional view of the present invention.

Referring to FIGS. 1 and 4, an internal combustion engine in accordance with the present invention is a four-stroke engine. The engine is comprised of multiple cylinder blocks (20) in series connected with the main shaft (30) in a circular casing (10). Spark plugs (12) are evenly distributed on the outside of the casing (10). Intake ports (14) and exhaust ports (16) are also defined in the casing (10). The number of spark plugs (12), intake ports (14) and exhaust ports (16) is the same.

Each cylinder block (20), which is rotatably fitted in the casing (10), has multiple cylinders (22) and pistons (220) movably received in the cylinders (22) (the figures show 4 cylinders and 4 pistons). The number of pistons (220) is twice the quantity of either the spark plugs (12), intake ports (12) or exhaust ports (14). Namely, there are two spark plugs, two intake ports and two exhaust ports in this embodiment and the angle distance between two similar elements (spark plugs, intake ports or exhaust ports) is 180°. The centerlines of the cylinders (22) are respectively perpendicular to the diameter of the casing (10). A connecting rod (222) is eccentrically pivotally mounted on a pinion (224), and the end of the connecting rod (222) is pivotally connected to the piston (220). The pinion (224) is rotatably attached to the cylinder block (20) by a shaft (226). A main gear (32) is stably mounted on the main shaft (30) by a key (34) to engage each pinion (224). An output shaft (24) is formed on the cylinder block (20) at end.

As shown in FIG. 1, all the pistons (220) move synchronously and arrive at the top of the cylinders (22) at the same time. The upper and lower cylinders (22) are vertical, and their associated pistons (220) installed therein are aligned with the spark plugs (12) and are ready for a power stroke. For the sake of simplicity, the two cylinder and piston combinations will be identified as "cylinder unit 1". The left and right cylinders (22) are horizontal and their associated pistons (220) installed therein have substantially completed an exhaust stroke and are ready for an intake stroke. Again for the sake of simplicity, these two cylinder and piston combinations will be identified as "cylinder unit 2"). When the spark plugs (12) ignites the air-fuel mixture in the cylinders (22) above the pistons (220) in cylinder unit 1, the pistons (220) are pushed inwards to rotate the cylinder block (20) clockwise.

Figure 2:
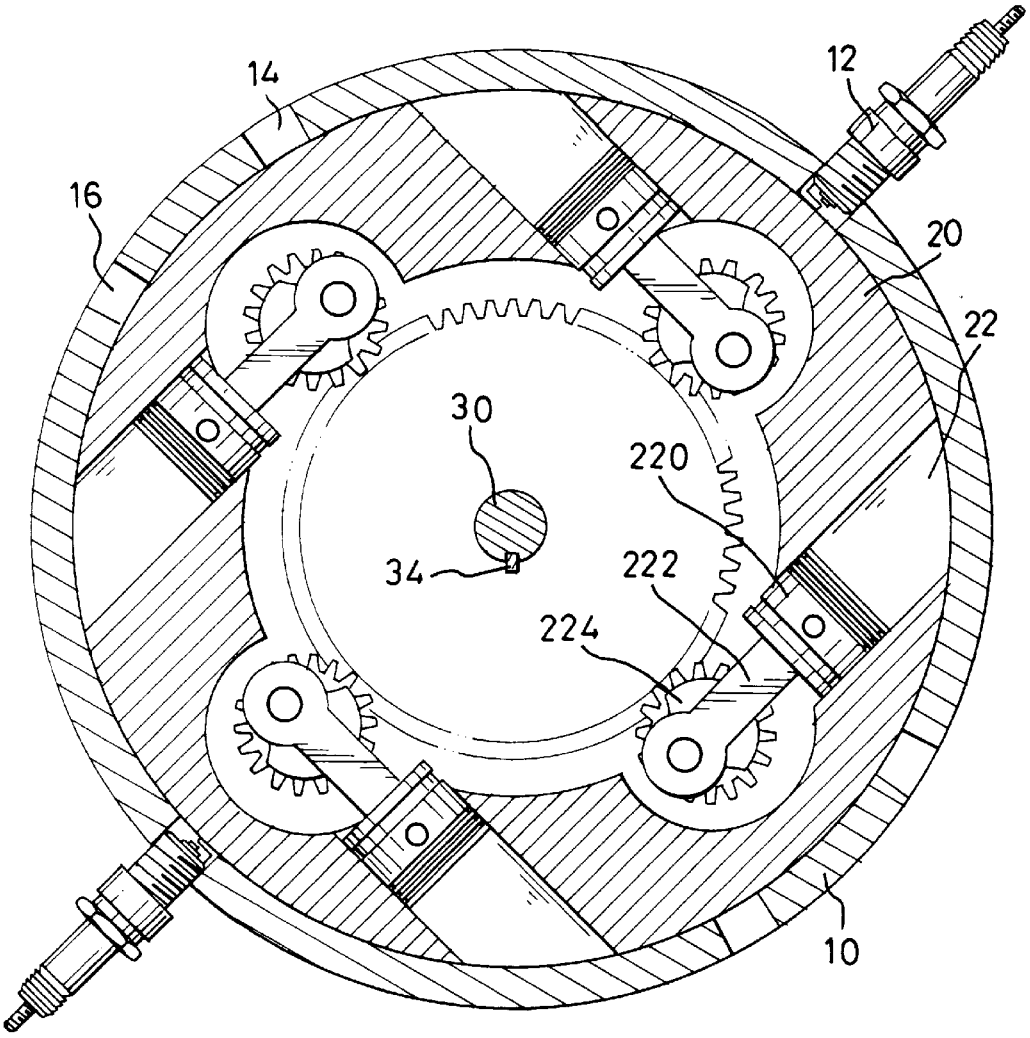
FIG. 2 is a cross-sectional view of the cylinder block of FIG. 1 rotated 45°.

Referring to FIG. 2, the cylinder block (20) has been rotated clockwise 45°. The pistons (220) of cylinder unit 1 have completed a power stroke and are ready for an exhaust stroke; the pistons (220) of cylinder unit 2 have completed an intake stroke and are ready for a compression stroke. Again, all pistons (220) simultaneously arrive at the bottom of the stroke.

The cylinder block (20) continues to rotate due to inertia and/or the driving force from other cylinder blocks, and all pistons (220) are pushed outwards. After having rotated another 45°, the cylinder block (20) arrives at a position such that cylinder unit 2 is in the same position as cylinder unit 1 shown in FIG. 1. Now cylinder unit 2 having completed a compression stroke is ready for a power stroke, and cylinder unit 1 having completed an exhaust stroke is ready for an intake stroke. The spark plugs ignites the air-fuel mixture again to repeat the process described above.

Because each cylinder (22) completes one stroke for each 45° the cylinder block rotates, each cylinder (22) will complete an entire four-stroke-cycle, namely, intake, compression, power and exhaust stroke, for every 180° that the cylinder block (20) rotates. Moreover, for every 90° that the cylinder block (20) rotates, two cylinders (22) complete a power stroke to supply energy. Thereby, the cylinder block (20) rotates continuously.

Figure 3:
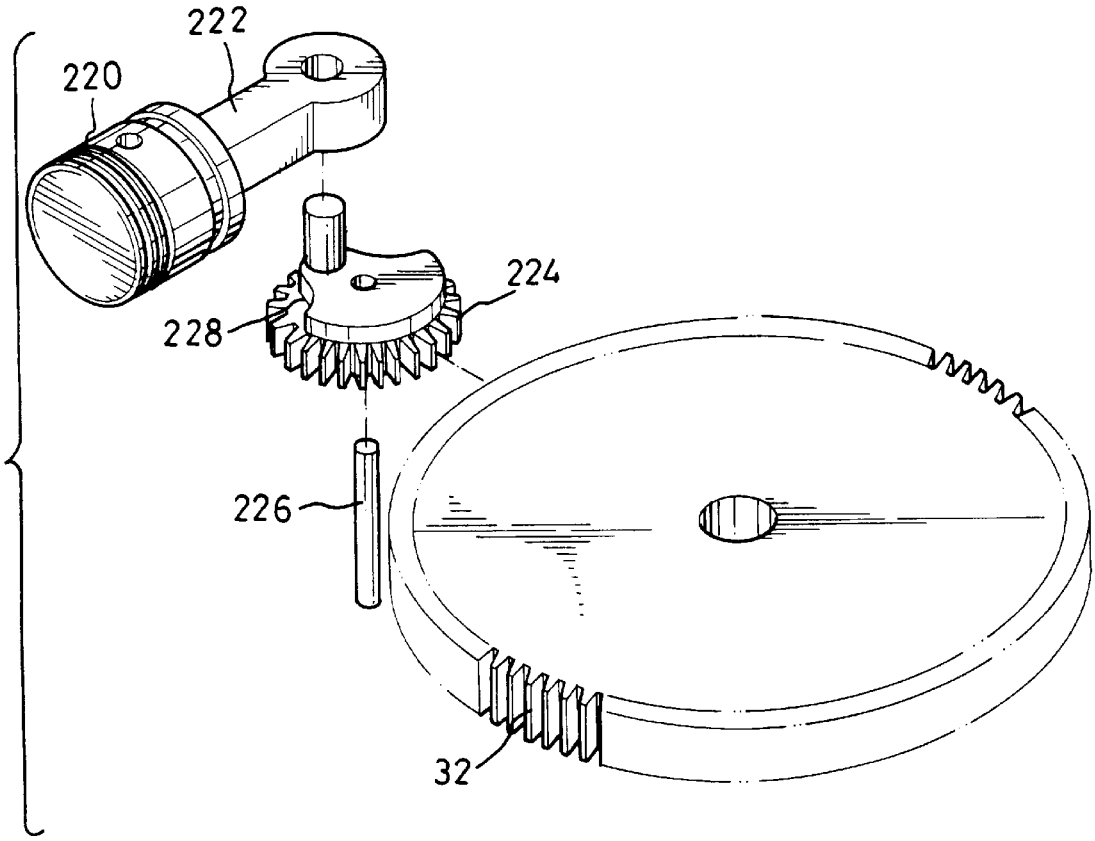
FIG. 3 is an exploded view of a piston, a pinion and a gear of the present invention.

Referring to FIG. 3, the piston (220) and the connecting rod (222) are similar to the conventional elements. It is noted that the connecting rod (222) is eccentrically mounted on the pinion (224) to convert the reciprocating linear motion to rotary motion. Notches (228) are defined in the pinion (224) to offset the weight of the pinion connecting post (unnumbered) and balance the pinion (224) so it will run smoothly.

Figure 5:
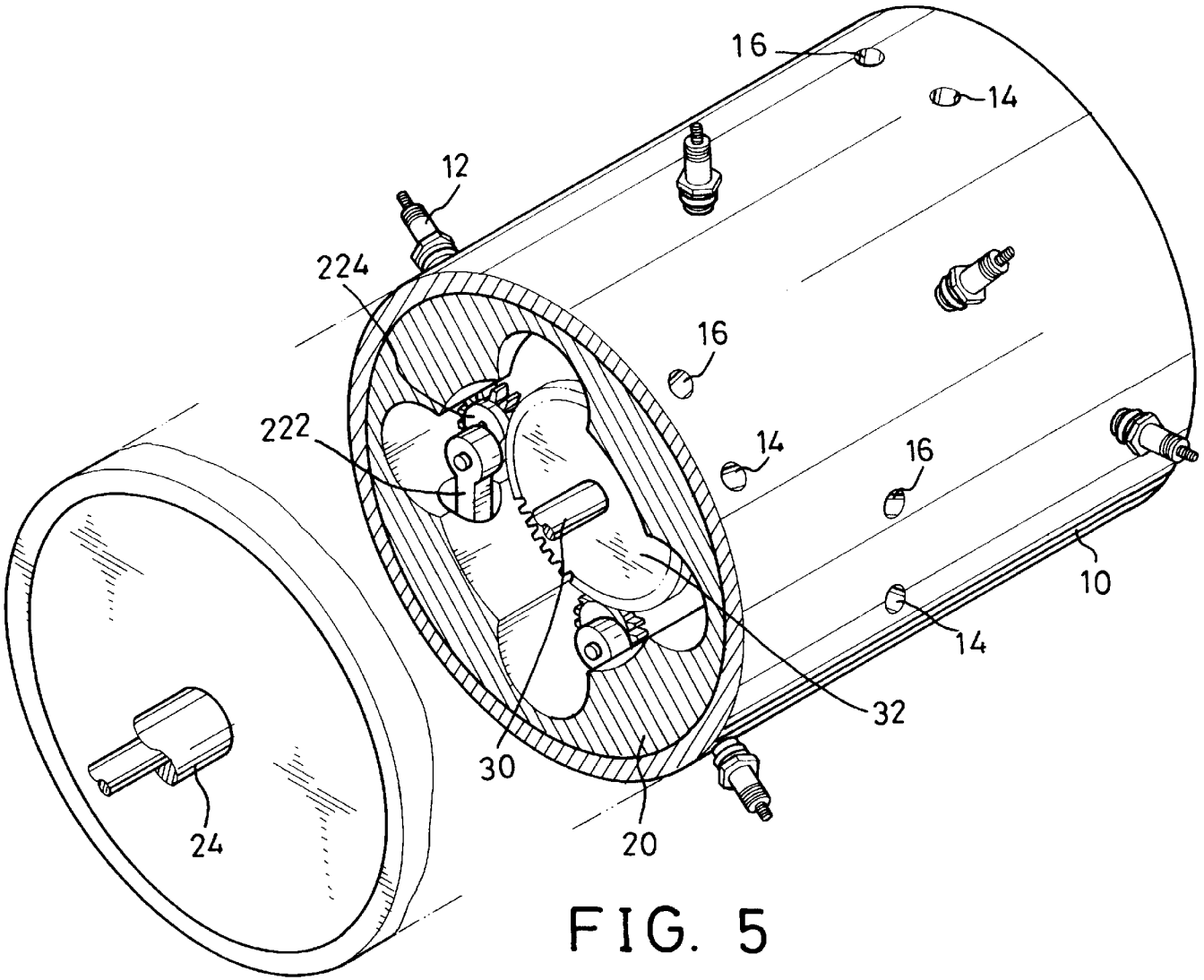
FIG. 5 is a perspective view in partial section of a preferred embodiment of the present invention.

According to the present invention, the internal combustion engine comprises multiple cylinder blocks (20) in series mounted in the casing (10), as shown in FIG. 4. As shown in FIG. 5, the spark plugs (12), intake ports (14) and exhaust ports (16) of adjacent cylinder blocks (20) are staggered by 45°. Alternatively, it is allowable to stagger the cylinder blocks (22) to align the spark plugs (12), the intake ports (14) and the exhaust ports (16).

Figure 6:
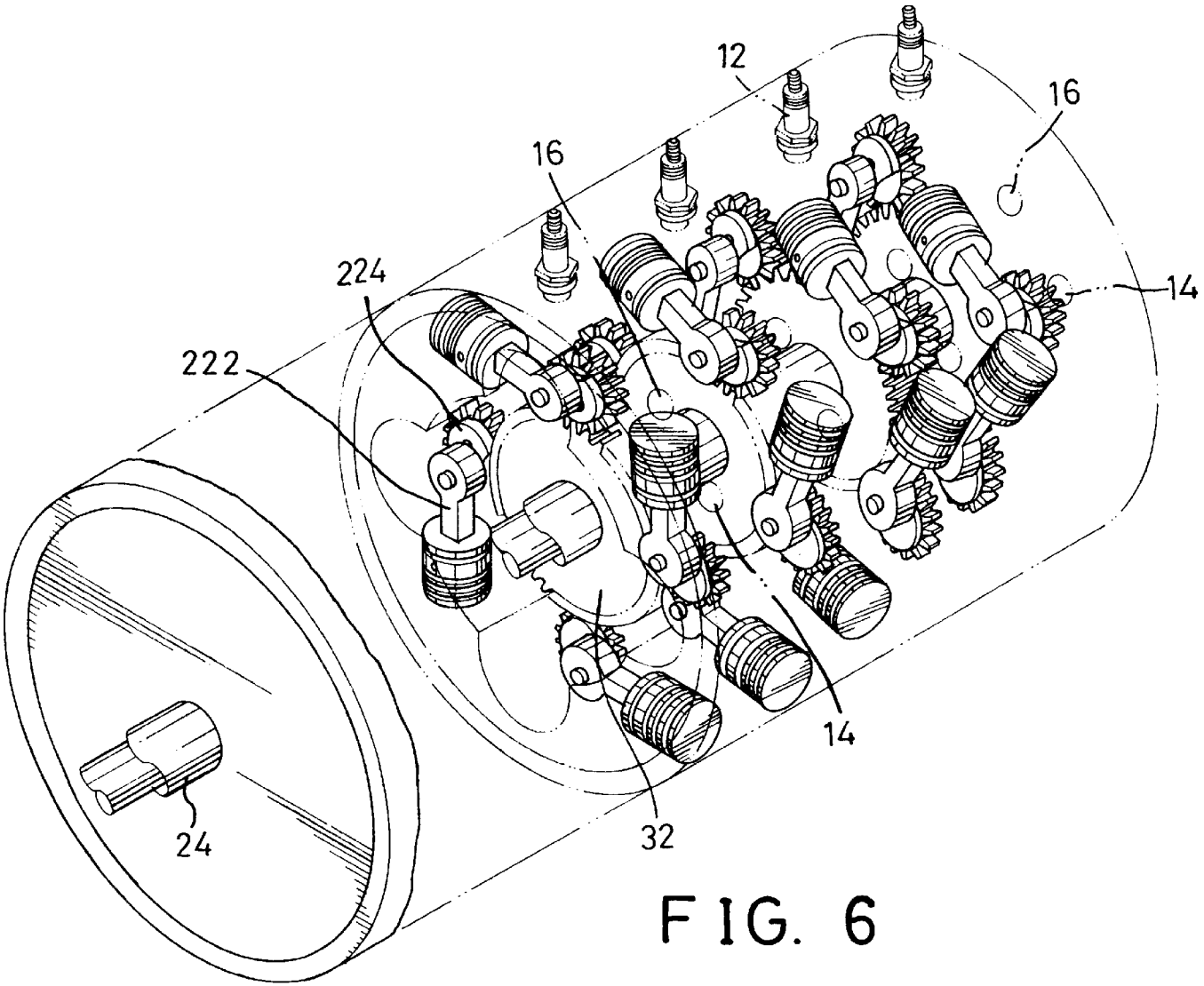
FIG. 6 is a perspective view in partial section of another preferred embodiment of the invention.

As shown in FIG. 6, the spark plugs (12) are in linear arrangement, which facilitates the arrangement of the cooling system of the engine to be located in one place rather than all around the casing (10).

Table 1 shows piston operating sequence for the engine. For purposes of illustration, the cylinder block (20) in FIG. 1 defines the original position (0°) of cylinder block 1. In this state, cylinder unit 1 of cylinder block I is ready for a power stroke, and cylinder unit 2 is ready for an intake stroke. When cylinder block 1 rotates from 0° to 45°, cylinder unit 1 and cylinder unit 2 have respectively completed the power stroke and the intake stoke, so "power/intake" is indicated in the block. Cylinder blocks 2, 3 and 4 are progressively later than cylinder block 1 by one stroke each, so that "compression/exhaust", "intake/power", and "exhaust/compression" are indicated in the corresponding blocks. Cylinder unit 1 of cylinder block 2 and cylinder unit 2 of cylinder block 4 are ready for a compression stroke that will consume energy. At the same time, cylinder unit 1 of the cylinder block 1 and cylinder unit 2 of cylinder block 3 are ready for a power stroke that will generate energy. Thus, the required energy of the compression stroke of cylinder blocks 2 and 4 can be provided by the power stroke of cylinder blocks 1 and 3. As shown in table 1, in an entire cycle, energy consumed by the compression stroke is provided by other cylinder blocks that have completed a power stroke. The engine does not need a flywheel to store energy for the compression stroke, so volume and weight of the engine can be reduced dramatically and the engine runs more smoothly.

Table 2 depicts the engine's energy state. In cylinder block 1, cylinder unit 1's operating sequence is "power-exhaust-intake-compression", and cylinder unit 2's simultaneous operating sequence is later than unit 1 by two strokes and is "intake-compression-power-exhaust". To overlay the two units, the total energy output is positive in the rotational sectors 0°–45°, 90°–135°, 180°–225° and 270°–315°, and is negative in the rotational sectors 45°–90°, 135°–180°, 225°–270° and 315°–360°. In cylinder block 2, cylinder unit 1's simultaneous operating sequence is later than cylinder unit 1 of cylinder block 1 by one stroke and is "compression-power-exhaust-intake", and cylinder unit 2's simultaneous operating sequence is "exhaust-intake-compression-power". To overlay the two units, the total energy output is positive in the rotational sectors 45°–90°, 135°–180°, 225°–270°, 315°–360°, and is negative in the rotational sectors 0°–45°, 90°–135°, 180°–225°, 270°–315°. Because the energy output of the two cylinder blocks (20) is complementary, the overall energy output of the cylinder blocks 1 and 2 is always positive. Cylinder blocks 3 and 4 operate in a similar manner to cylinder blocks 1 and 2, and the energy output of cylinder blocks 3 and 4 is also always positive. The combined energy output all these cylinder blocks 1, 2, 3, and 4 operating simultaneously is continuous and smooth without undulation.

The advantages of the present invention are:

1. The internal combustion engine does not need a flywheel, thereby greatly reducing volume and weight of the engine, 2. The internal combustion engine in accordance with the present invention is simpler and more efficient, so the fabrication cost and maintenance cost are less expensive.

3. More cylinder blocks can be freely added to the internal combustion engine in accordance with the present invention to attain the required power.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

TABLE 1

CYLINCRICAL BLOCKS' OPERATING SEQUENCE

| | Cylindrical block 1 | Cylindrical block 2 | Cylindrical block 3 | Cylindrical block 4 |
|---|---|---|---|---|
| 0–45° | Power/Intake | Compression/Exhaust | Intake/Power | Exhaust/Compression |
| 45–90° | Exhaust/Compression | Power/Intake | Compression/Exhaust | Intake/Power |
| 90–135° | Intake/Power | Exhaust/Compression | Power/Intake | Compression/Exhaust |
| 135–180° | Compression/Exhaust | Intake/Power | Exhaust/Compression | Power/Intake |
| 180–225° | Power/Intake | Compression/Exhaust | Intake/Power | Exhaust/Compression |
| 225–270° | Exhaust/Compression | Power/Intake | Compression/Exhaust | Intake/Power |
| 270–315° | Intake/Power | Exhaust/Compression | Power/Intake | Compression/Exhaust |
| 315–360° | Compression/Exhaust | Intake/Power | Exhaust/Compression | Power/Intake |

TABLE 2
Energy Output of Cylindrical Blocks
Energy Output of the Cylinder Units of the Cylindrical Block 1
Cylinder unit 1:
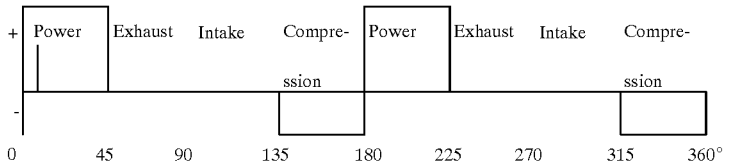
Cylinder unit 2:
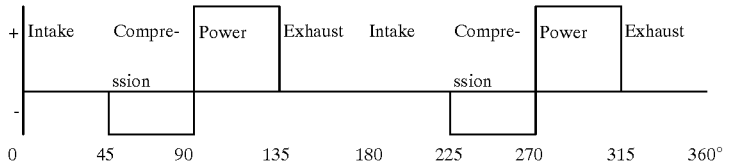
Total Energy output of the cylindrical block 1
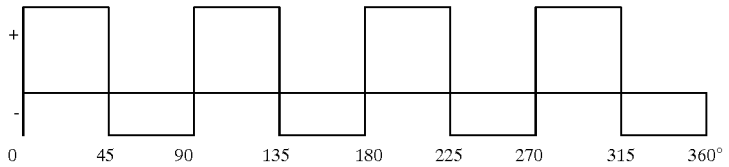
ENERGY OUTPUT OF CYLINDRICAL BLOCK 2
Cylinder unit 1:
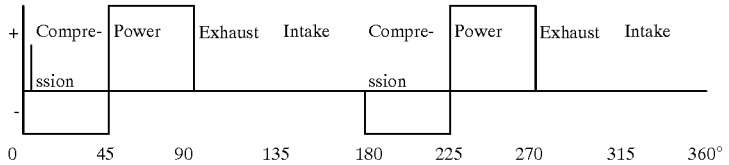
Cylinder unit 2:
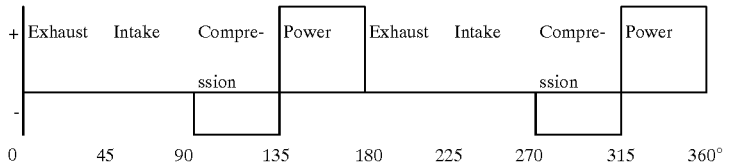
Total Energy output of the cylindrical block 2
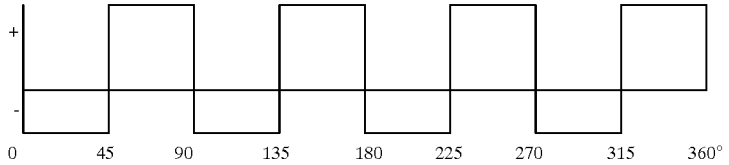
ENERGY OUTPUT OF CYLINDRICAL BLOCK 3
Cylinder unit 1:
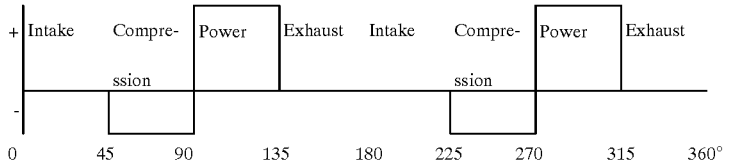

TABLE 2-continued

Energy Output of Cylindrical Blocks

Cylinder unit 2:

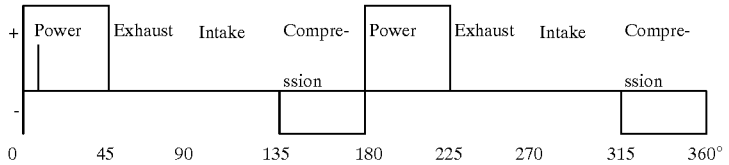

Total Energy output of the cylindrical block 3

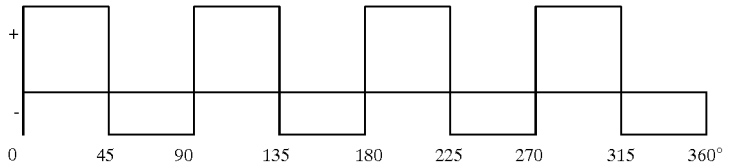

ENERGY OUTPUT CYLINDRICAL BLOCK 4

Cylinder unit 1:

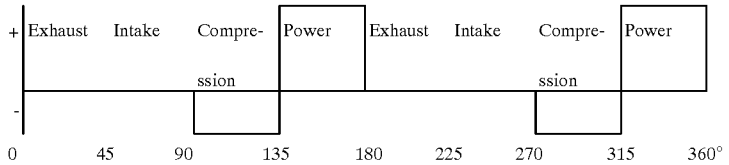

Cylinder unit 2:

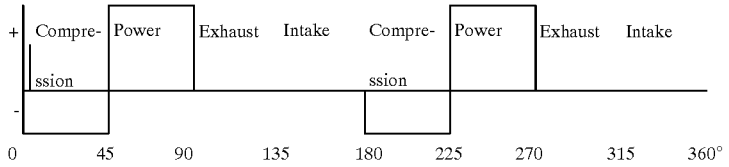

Total Energy output of the cylindrical block 4

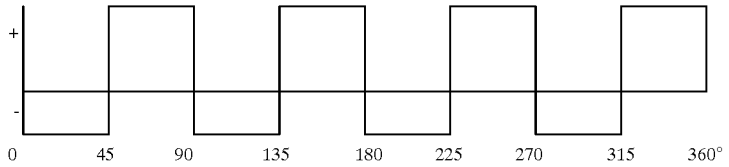

TOTAL ENERGY OUTPUT OF CYLINDRICAL BLOCKS 1 AND 2

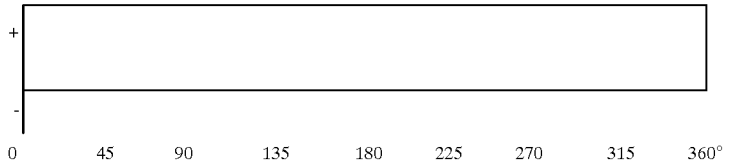

Total energy output of the cylindrical blocks 3 and 4

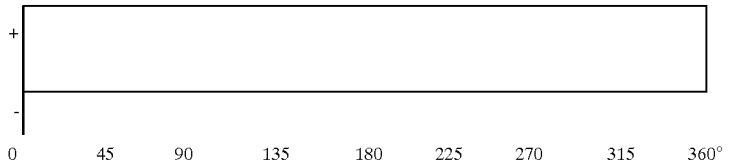

Total energy output of the cylindrical blocks 1, 2, 3, and 4

TABLE 2-continued

| Energy Output of Cylindrical Blocks |
|---|
| 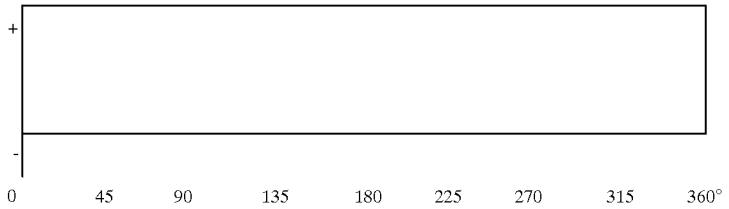 |

What is claimed is:

1. An internal combustion engine comprising:

a casing having multiple spark plugs on the periphery thereof, and multiple exhaust ports and intake ports defined in the periphery thereof;

a shaft centrally provided in the casing;

multiple gears fixed on the shaft;

multiple cylinder blocks rotatably provided in series in said casing and each corresponding to one of the gears respectively, each cylinder block having multiple cylinders, defined along a circumferential portion of the cylinder block to respectively receive a piston therein, each of the cylinders being accessible to one of the spark plugs, the exhaust ports or the intake ports upon rotation of the cylinder block, wherein the piston is pivotally attached to a connecting rod which is pivotally connected to a pinion which in turn meshes with one of the corresponding gears; and an output shaft integrally formed on the end of the cylinder blocks;

wherein the connecting rod is eccentrically connected to the pinion, and the pinion is fixed on the cylinder block by a shaft;

wherein each of the cylinder blocks comprises four cylinders and the casing provides two spark plugs, two exhaust ports and two intake ports to each of the cylinder blocks;

wherein the cylinder blocks are located in a staggered manner;

wherein the centerlines of the cylinders are non-radial to the centerline of the casing;

whereby, each piston sequentially reciprocates through a power stroke, an exhaust stroke, an intake stroke and a compression stroke to rotate the pinion by the connecting rod; and whereby the rotation of the pinions causes the cylinder blocks to rotate with respect to the gears to supply a rotational power output through the output shaft.

2. The internal-combustion engine as claimed in claim 1, wherein a notch is defined in the periphery of each pinion.

3. The internal-combustion engine as claimed in claim 1, wherein the spark plugs are linearly arranged on the casing.

4. The internal-combustion engine as claimed in claim 1, wherein a single pinion and gear are arranged inside each respective cylinder block.

* * * * *